US006355128B1

(12) United States Patent
Eronen

(10) Patent No.: US 6,355,128 B1
(45) Date of Patent: Mar. 12, 2002

(54) DEVICE AND METHOD FOR MAKING A SPLICE INTO A PAPER WEB

(75) Inventor: Pekka Eronen, Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/473,484

(22) Filed: Dec. 28, 1999

(30) Foreign Application Priority Data

Dec. 28, 1998 (FI) ..... 982803

(51) Int. Cl.[7] ..... B65H 21/00

(52) U.S. Cl. ..... 156/159; 156/271; 156/502; 156/507; 156/512; 242/553

(58) Field of Search ..... 156/157, 159, 156/271, 502, 505, 507, 512; 242/551, 552, 553

(56) References Cited

U.S. PATENT DOCUMENTS

| | | | | |
|---|---|---|---|---|
| 3,813,053 A | | 5/1974 | Butler, Jr. et al. | 242/58.4 |
| 3,957,567 A | | 5/1976 | Pursell et al. | 156/505 |
| 4,374,676 A | | 2/1983 | Ryan | 242/58.4 |
| 4,629,531 A | | 12/1986 | Kataoka | 156/504 |
| 4,936,942 A | | 6/1990 | Sollinger, et al. | 156/504 |
| 5,322,230 A | * | 6/1994 | Dylla et al. | 156/504 X |
| 5,487,805 A | | 1/1996 | Boriani et al. | 156/159 |
| 5,804,020 A | * | 9/1998 | Akao et al. | 156/251 |
| 6,161,793 A | * | 12/2000 | Lindstrand | 242/556 |

FOREIGN PATENT DOCUMENTS

| | | | |
|---|---|---|---|
| DE | 4408814 | 9/1994 | B65H/19/18 |
| DE | 29701759 | 10/1997 | |
| EP | 0118384 | 9/1984 | |
| GB | 2269369 | 2/1994 | |

* cited by examiner

*Primary Examiner*—Mark A. Osele
(74) *Attorney, Agent, or Firm*—Steinberg & Raskin, P.C.

(57) ABSTRACT

The invention concerns a device for making a splice into a paper web, which device (10) has been fitted to be used as an auxiliary device in making a cross-direction splice between two ends of a web in a winder. The device (10) comprises a suction zone (11) for immobilizing the web and means (15) for keeping the device (10) in the desired location. The device has been attached to the frame constructions of the winder by means of relief devices. The invention also concerns a method for making a splice into a paper web, in which method a cross-direction splice is prepared between two ends of a web in a winder by means of a device (10) operating as an auxiliary device. In the method, the web is immobilized in a suction zone (11) of the device (10). In the method the device (10) is kept in its place by means of devices (15), and the device (10) is operated as relieved by means of relief devices as attached to the frame constructions of the winder.

10 Claims, 4 Drawing Sheets

DEVICE AND METHOD FOR MAKING A SPLICE INTO A PAPER WEB

FIELD OF THE INVENTION

The invention concerns a device for making a splice into a paper web, which device has been fitted to be used as an auxiliary device in making a cross-direction splice between two ends of a web in a winder.

BACKGROUND OF THE INVENTION

The invention also concerns a method for making a splice into a paper web, in which method a cross-direction splice is prepared between two ends of a web in a winder by means of a device operating as an auxiliary device.

As is known from the prior art, in winders, e.g. slitters, a cross-direction splice or joint is made between two webs manually, and in the stage of making the splice a number of persons are needed in order that the handling of the web ends could be controlled so that a splice can be produced. In some prior-art solutions, a what is called splice making table is used as an aid for making the splice, in which splice making table suction is applied, but also with this prior art solution, a number of persons are needed to produce a splice.

OBJECTS AND SUMMARY OF THE INVENTION

The object of the present invention is to provide a device and a method by whose means just one person is required in making a cross-direction splice.

It is a further object of the invention to provide a device and a method by whose means the making of a splice is simple and rapid.

In view of achieving the objectives stated above and those that will come out later, the device in accordance with the invention is mainly characterized in that the device comprises a suction zone for immobilizing the web, means for keeping the device in the desired location, and that the device has been attached to the frame constructions of the winder by means of relief devices.

On the other hand, the method in accordance with the invention is mainly characterized in that, in the method, the web is immobilized in a suction zone of the device, that in the method the device is kept in its place by means of devices, and that the device is operated as relieved by means of relief devices as attached to the frame constructions of the winder.

When the device and the method in accordance with the invention are used, making of a cross-direction splice between two webs is easy and simple. In the making of the splice, just one person is needed, in which case the costs become lower since several people are not needed for making the splice.

The device in accordance with the invention comprises means for handling of the web and means for keeping the device in its place. In accordance with the invention, a device is used which has been suspended preferably as relieved by means of a relief device, for example, on the frame constructions of the machine, and the device can be displaced, in which case it is easy to handle. The width of the device is preferably equal to the width of the machine, in which case a splice can be made by means of the device across the width of the whole machine, either for component webs of, if desired, for a web of full width.

The device in accordance with the invention is also versatile, and it can be used as an aid irrespective of the way in which the splice is supposed to be accomplished. The device can be used both in connection with butt joint splices and in connection with overlapping splices, and the various working steps in the making of the splice can be carried out in the desired way in the desired sequence.

According to a favourable additional feature of the invention, the auxiliary device also includes a web cut-off controller. The device can be operated preferably by means of foot pedals, in which case the operating controls of the device are constantly within the reach of, and usable by, the person who is making the splice.

The device in accordance with the invention favourably comprises a suction zone for immobilizing the web and a separate area. e.g. provided with suction cups, for keeping the device in its place as well as a cut-off controller and an edge for finishing the splice.

BRIEF DESCRIPTION OF THE DRAWINGS

In the following, the invention will be described in more detail with reference to the figures in the accompanying drawing, the invention being not supposed to be strictly confined to the details of said illustrations.

DETAILED DESCRIPTION OF THE INVENTION

Figure 1:
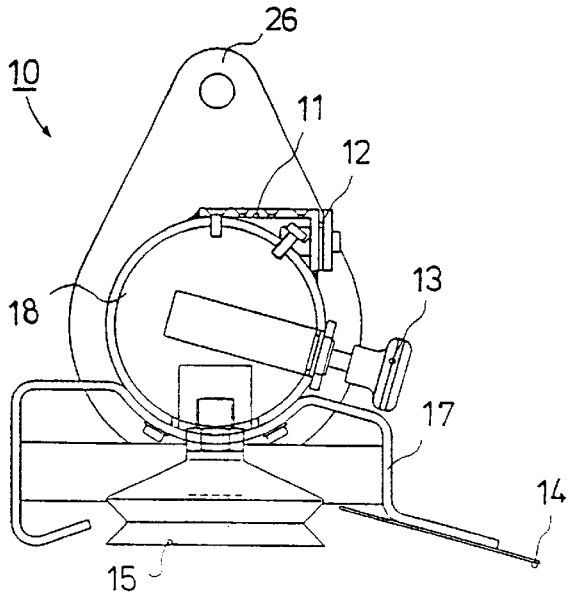
FIG. 1 is a schematic illustration of an embodiment of the device in accordance with the invention.

As is shown in FIG. 1, the device 10 in accordance with the invention comprises a suction zone 11 for immobilizing the web, a cut-off groove 12 for controlling the cutting-off when the web is cut off by means of a blade or equivalent, a directional valve 13 for controlling of suction cups 15, by means of which suction cups 15 the device 10 is attached in its place for the time of certain steps in the method, and an edge 14 for removing an extra border area from a splice that has been made. The device 10 is attached to the frame constructions of the machine by means of relief devices fitted in connection with end flanges 26. Further, the device 10 comprises operating controls, preferably foot pedals (not shown), for steering and controlling the operations of the device 10.

Figure 2:
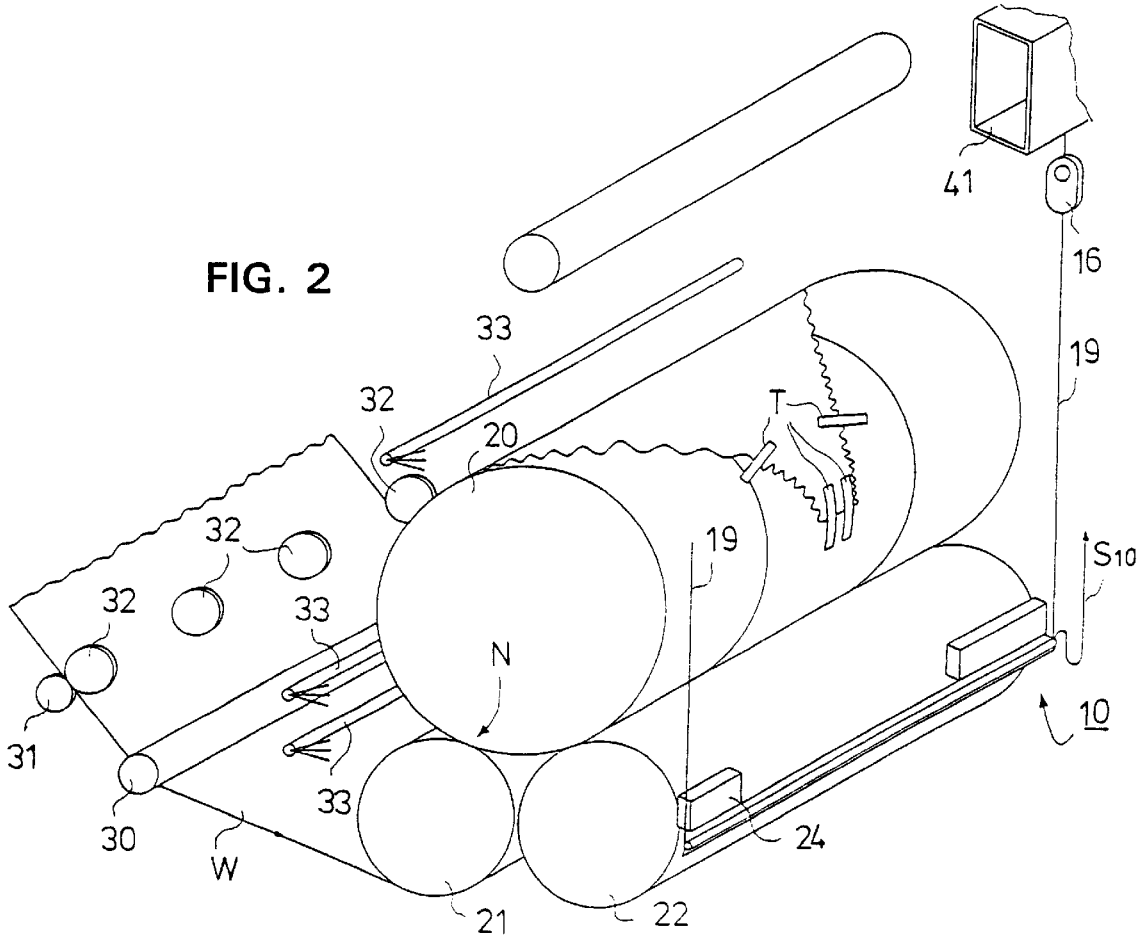
FIGS. 2 through 8 are schematic illustrations of the making of a splice by means of the method in accordance with the invention.

The winder shown in FIGS. 2 through 8 is a drum slitter-winder, which comprises a forward winding drum 22 and a rear winding drum 21, on which the paper roll 20 that is being formed is placed, onto which roll the web W is wound through the nip N between the rear winding drum 21 and the paper roll 20 that is being formed. The blades of the slitter are denoted with the reference numerals 31 and 32, and in this slitter there are four pairs of blades 31,32 as well as blow devices 33 for controlling the web W. In FIGS. 2 . . . 8 the senses of rotation of the rolls 21, 22 and of the roll 20 are denoted with the arrows S21, S22 and S20, respectively. The movements of the device 10 are illustrated by the arrows S10.

In the stage shown in FIG. 2, the device 10 in accordance with the invention is in its home position in front of the forward drum 22 of the slitter below the shield profile 24. The device 10 has been suspended by means of ropes or equivalent 19, by the intermediate of relief devices 16, on the frame constructions 41 of the machine. The width of the device 10 in accordance with the invention is equal to the width of the machine, and it comprises a suction zone 11 (FIG. 1) and suction cups 15 at the bottom face (FIG. 1).

In the following, the method in accordance with the invention will be described generally with reference to FIGS. 2 through 8.

In the method in accordance with the invention, in view of making a cross-direction splice between web ends, the web W is first passed through the slitter, and after this the end of the web W is attached to the roll 20, and the web is wound a few rounds around the roll until the web W has become straight and free from wrinkles. After this the web W starts being slit into component webs, and the web is wound onto the roll 20. The damaged surface portion is removed from the face of the roll 20, in which connection the device 10 in accordance with the invention is attached to the side of the roll by means of the suction cups 15, and the border area of the portion to be removed is turned into the suction zone of the device 10, and paper is wound around the device 10, and the operator shifts the device away from the roll, and the web is made to flow away from the roll 20. After this the web W is cut off, and the web to be removed is made to flow away from the roll 20 and from around the device 10. After this the device 10 is attached by means of the suction cups 15 to the face of the forward winding drum 22, in which connection, from under the surface layer, one end WA of the web is pulled to the suction zone 11 of the device, and, with the aid of the cut-off groove 12, the web is cut off. After this, an adhesive tape is attached to the cut-off area. The device 10 is attached to the side of the roll 20. and the border area of the cut-off surface sheet, i.e. the other end WB of the web, is affixed to the suction zone of the device 11, and web is wound around the device 10. The device 10 is shifted away from the roll until the splice area is at a suitable working height, and the web W is cut off from below the splice area. The extra web is removed. The device is attached to the side of the roll, and the edge 14 is aligned so that the location of the splice becomes precise, after which the device 10 is attached by means of the suction cups 15, and the extra border area is torn off by means of the edge 14. After this, the splice is finished, for example, by means of a shield tape, and any extra splice tapes and the tape between the component rolls 20' are cut off, and the device 10 is removed and returned to the home position, and winding is continued.

In the following, making of a splice will be described in detail with reference to an exemplifying embodiment, and with the aid of the device 10 in accordance with the invention, reference is made to the method steps illustrated in FIGS. 2 through 8. First, the paper web W is passed through the slitter by means of threading blowings produced by means of the blow device 33, in a way in itself known, and in this connection the blades 31, 32 of the slitter are open, i.e. the web W is not slit into component webs. After the end of the web W has passed through the slitter, it is attached, for example, by means of an adhesive tape T to the roll 20, and after this, with a crawling speed, a few layers of paper are wound around the roll 20 until the web W has become straight and free from wrinkles. At this stage, the web tension is kept preferably even and at a level of at least one half of the normal running tension. After this, the upper blades 32 are lowered to the slitting position until the web W that has been slit into component webs W' has passed through the slitter and been positioned properly on the roll 20, and the crawling is stopped.

Figure 3:
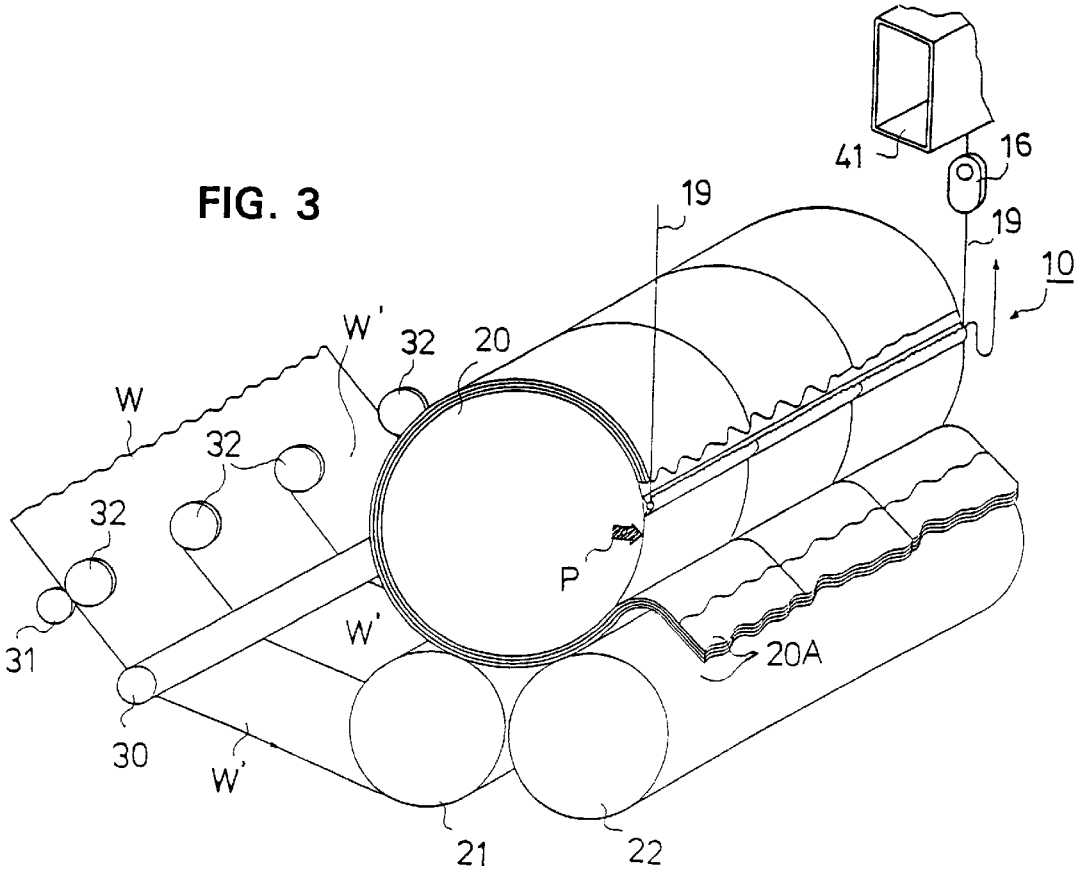

As is shown in FIG. 3, next, by means of a knife or a hand cutter, a cut deep enough is made into the roll 20 so that the surface portion 20A of the roll 20, which is wrinkled and which has been damaged by paper clods in connection with a situation of web break, can be removed. The cut into the last layer is made into a position slightly lower than in the preceding layers, and this point P is marked on the end of the roll. After this the suction cups 15 of the device 10 in accordance with the invention are attached to the side of the roll 20 and the border area is turned onto the suction zone 11 placed at the top of the device 10.

Figure 4:
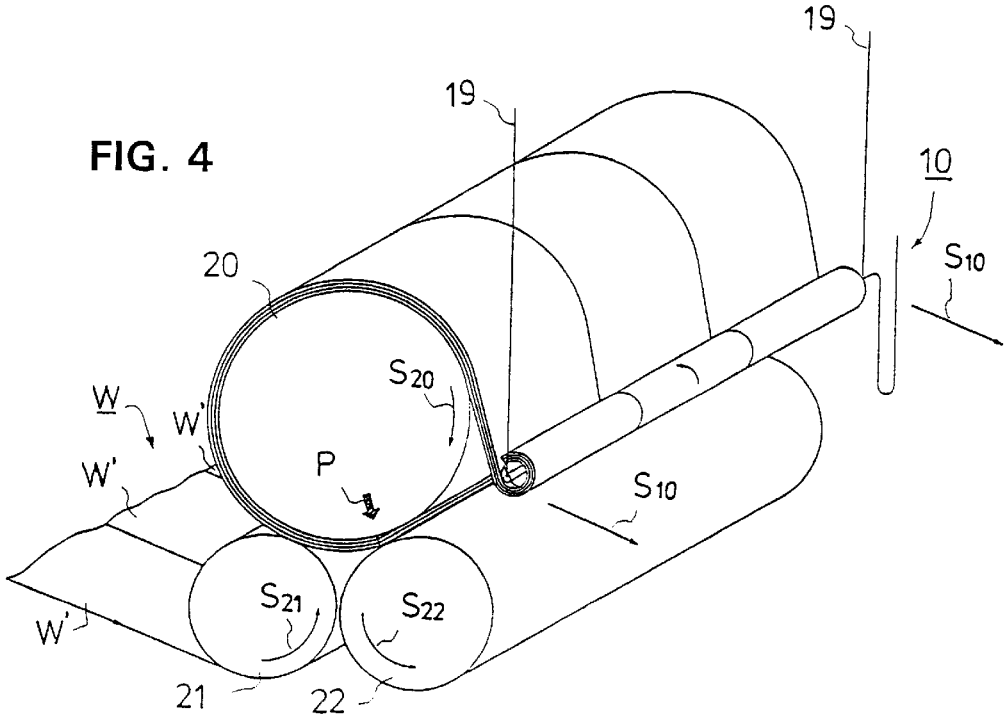

As is shown in FIG. 4, the slitter is made to crawl in order to wind the paper about one round around the device 10 in accordance with the invention. After this the operator moves backwards in the way indicated by the arrows S10 towards the lowering device, and the web W is allowed to flow down onto the floor in front of the forward winding drum 22.

Figure 5:
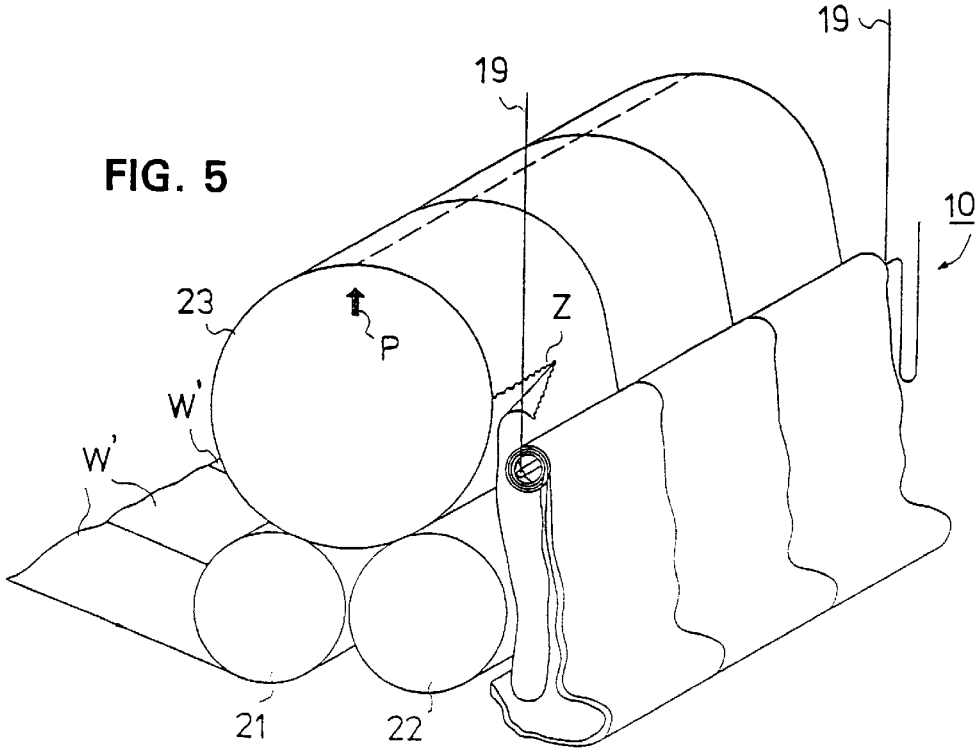

After all the portion to be removed has come away from around the roll 20, i.e. the mark P placed at the end of the roll is directed roughly upwards in the way shown in FIG. 5, the web W is cut off approximately at the center line of the roll 20, which cut-off point is denoted with the reference Z, and the web to be removed is allowed to flow from the roll and from around the device 10 onto the floor, after which the portion to be removed is cleaned off.

Figure 6:
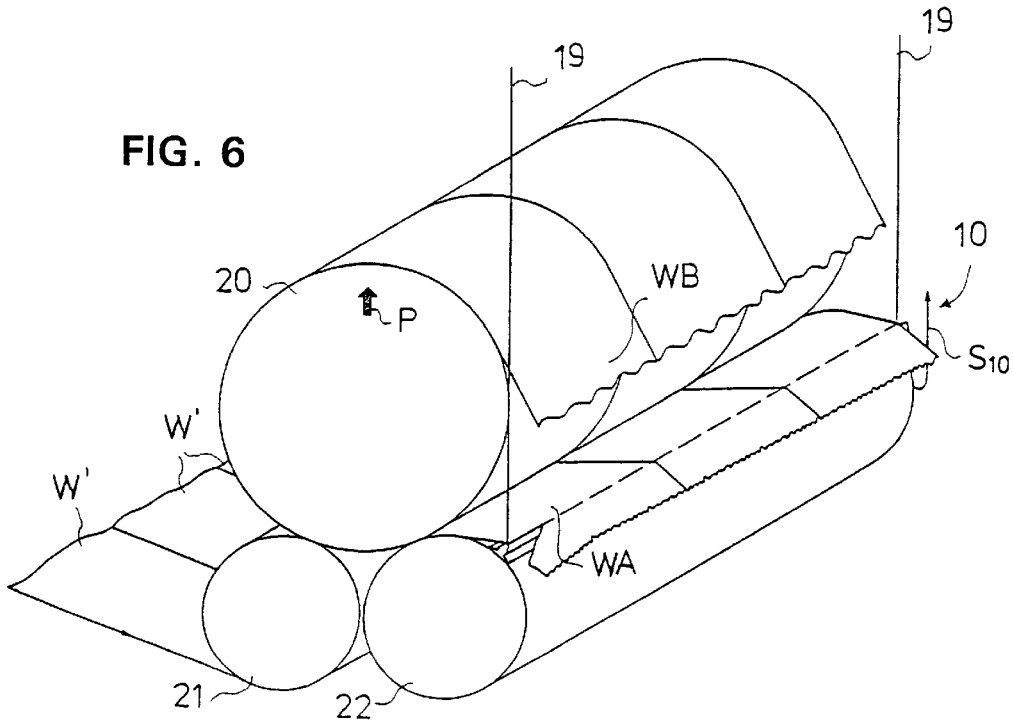

As is shown in FIG. 6, the device 10 in accordance with the invention is attached by means of the suction cups 15 to the face of the forward winding drum 22 at a suitable working level, and one end WA of the paper is pulled from under the surface layer, and the web end WA is placed evenly on the suction zone 11 of the device 10 in accordance with the invention, after which with the aid of the cut-off groove 12, the web end WA is cut off. After this a one-sided adhesive tape is spread halfway beyond the cut-off point, and the suction is removed from the device 10 in accordance with the invention, and the device 10 is raised to a higher level, as is indicated by the arrows S10.

Figure 7:
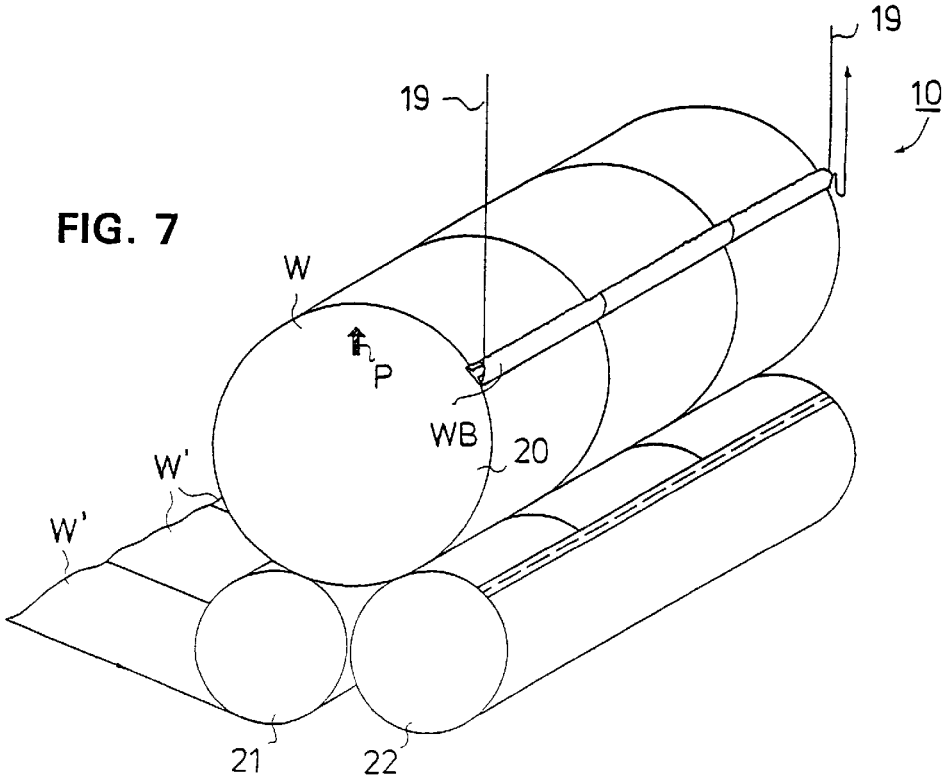

As is shown in FIG. 7, after this, the device 10 in accordance with the invention is attached to the side of the roll 20, and the border area WB of the cut-off surface sheet is turned onto the suction zone 11 of the device 10 in accordance with the invention, and the slitter is made to crawl, and the paper is wound about one round around the device 10, and the operator moves backwards with the device 10 towards the lowering device. The splice area is stopped at a suitable working level, and the web is cut off below the splice area. The web is removed from the device 10 onto the floor and cleaned off.

Figure 8:
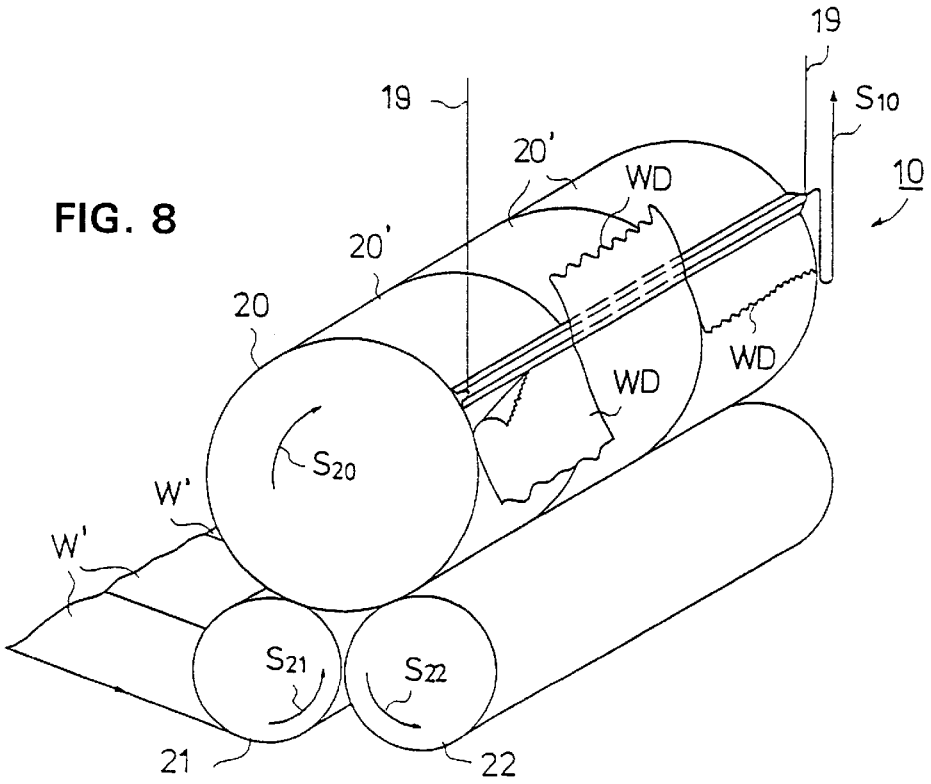

After this, as is shown in FIG. 8, the edge 14 in the device 10 in accordance with the invention is operated, and the border areas WD of the splice are removed. The middle point of the device is attached to the side of the roll 20, and the operator moves to one end of the roll, and the edge 14 is aligned precisely at the splice. This is repeated at the other end, and the location of the splice 14 is confirmed again in the middle. When the alignment is as desired, the suction cups 15 are taken to use, and the border areas WD are torn off along the edge 14. If necessary, it is possible to use, e.g., shield tape for finishing of the splice. Any extra length of the splice tapes is cut off from the ends, and the tape is cut off from between the separate rolls 20', and the suction is switched off and the device 10 is passed to its home position. After this the broke paper is removed from the slitter, and after a short crawling stage the winding is continued normally.

Above, the invention has been described with reference to a preferred exemplifying embodiment of same only, the invention being, however, not supposed to be strictly confined to the details of said embodiment. Many modifications and variations are possible within the scope of the inventive idea defined in the following patent claims.

What is claimed is:

1. A device for making a splice into a paper web, which device (10) has been fitted to be used as an auxiliary device in making a cross-direction splice between two ends (WA, WB) of a web (W) in a winder, wherein the device (10) comprises a suction zone (11) for immobilizing the web (W), means (15) for keeping the device (10) in the desired location, and that the device has been attached to the frame constructions of the winder by means of relief devices (16).

2. A device as claimed in claim 1, wherein the device (10) further comprises an edge (14) for finishing the splice.

3. A device as claimed in claim 1, wherein the device (10) further comprises a cut-off controller (12) for controlling the cut-off of the web (W).

4. A device as claimed in claim 1, wherein the means (15) for attaching the device are suction cups (15) controllable by means of a directional valve (13).

5. A device as claimed in claim 1, wherein the device (10) further comprises foot-operated operating switches.

6. A method for making a splice into a paper web, in which method a cross-direction splice is prepared between two ends (WA, WB) of a web (W) in a winder by means of a device (10) operating as an auxiliary device (10), wherein, in the method, the web (W) is immobilized in a suction zone (11) of the device (10), that in the method the device (10) is kept in its place by means of devices (15), and that the device (10) is operated as relieved by means of relief devices (16) as attached to the frame constructions of the winder.

7. A method as claimed in claim 6, wherein, in the method, the web (W) is cut off as controlled by the cut-off controller (12) of the device (10).

8. A method as claimed in claim 6, wherein, in the method, the splice is finished with the aid of the edge (14) of the device (10).

9. A method as claimed in claim 6, wherein the device (10) is operated by means of foot-operated operating switches.

10. A method as claimed in claim 6, wherein, in the method, the web (W) is passed through the slitter and attached to the roll (20), that the web (W) is wound around the roll (20), that the damaged surface portion is removed from the surface of the roll (20), that by means of the device (10), the damaged layers are shifted away from around the roll while the damaged layers are immobilized in the suction zone (11) of the device (10), that the web (W) is cut off and the web (W) is allowed to flow away from around the roll (20) and from around the device (10), that the device is attached by means of suction cups (15) into connection with the winder, and the web end to be spliced is fitted into the suction zone (11) of the device (10), that with the aid of the cut-off controller (12) of the device (10), the web end (WA) is cut off and a splice tape or equivalent is attached to the splice, that the device (10) is attached to the roll (20), and the other web end (WB) to be spliced is attached to the suction zone (11) of the device (10), that the splice area is stopped at a suitable working height, and the web (W) is cut off, and any extra web (W) is removed from around the device (10), and the extra border areas at the splice are removed while making use of the edge device (14) as an aid, that the edge (14) is aligned with the splice area, and the splice is finished, and that the device (10) is removed to its home position, and the winding is continued.

* * * * *